US007238125B2

(12) United States Patent
Dymling

(10) Patent No.: US 7,238,125 B2
(45) Date of Patent: Jul. 3, 2007

(54) GREEN RESTORING DEVICE HAVING A GOLF BALL MARKER

(76) Inventor: Richard Dymling, Kompassvagen 1, Lidingo (SE) S-181 30

( * ) Notice: Subject to any disclaimer, the term of this patent is extended or adjusted under 35 U.S.C. 154(b) by 66 days.

(21) Appl. No.: 10/540,603

(22) PCT Filed: Jan. 12, 2004

(86) PCT No.: PCT/SE2004/000019

§ 371 (c)(1),
(2), (4) Date: Jun. 27, 2005

(87) PCT Pub. No.: WO2004/062747

PCT Pub. Date: Jul. 29, 2004

(65) Prior Publication Data

US 2006/0247075 A1 Nov. 2, 2006

(30) Foreign Application Priority Data

Jan. 13, 2003 (SE) ..... 0300039
Feb. 5, 2003 (SE) ..... 0300288

(51) Int. Cl.
*A63B 57/00* (2006.01)

(52) U.S. Cl. ..... 473/408

(58) Field of Classification Search ..... 473/406, 473/408, 286; D21/793, 795; 30/162, 163, 30/123, 136, 143; 7/118
See application file for complete search history.

(56) References Cited

U.S. PATENT DOCUMENTS 174,417 A * 3/1876 Evans ..... 30/162
3,360,807 A * 1/1968 Mauck ..... 7/158
3,456,737 A * 7/1969 Rhyme ..... 172/381
3,539,017 A * 11/1970 Johnson ..... 172/378
4,941,260 A * 7/1990 Castelluzzo ..... 30/162
4,955,609 A 9/1990 Kassen
5,388,824 A * 2/1995 Reimers ..... 473/406
D425,163 S * 5/2000 Cauffman et al. ..... D21/793
6,413,173 B1 * 7/2002 Muller et al. ..... 473/408
6,413,174 B1 7/2002 Roberts
6,428,430 B1 8/2002 Chong
6,620,062 B2 * 9/2003 Taylor et al. ..... 473/408
6,837,807 B1 * 1/2005 Kerr ..... 473/408

FOREIGN PATENT DOCUMENTS

SE 8900397 A * 8/1990

* cited by examiner

*Primary Examiner*—Steven Wong
(74) *Attorney, Agent, or Firm*—David A. Guerra

(57) ABSTRACT

A green restoring device in the form of a tool by means of which damages, in particular impressions in a golf green, caused by the impact of a golf ball, can be repaired, and comprising a carrier (1) in which a green restoring tool (2) is arranged to be maintained in fully retracted and fully expelled position, respectively, and in which the carrier is made of a non-magnetic material and the carrier (1), at the front end thereof, if formed with means (11, 12; 12*a*; 12*b*) for cleaning the tool (2) while the tool is being retracted into the carrier (1). The carrier (1) of the green restoring device is a) at the front end thereof and at the underside thereof formed with a recess (6) having a magnet (7) for holding a marker button easily releasable, and b) at the rear end thereof formed with a built in magnet (9) for holding the tool (2) under magnetic action in its fully retracted position, and a slot (10), in which a fixing clip (4) is adapted to be secured.

19 Claims, 3 Drawing Sheets

GREEN RESTORING DEVICE HAVING A GOLF BALL MARKER

The present invention generally relates to a so called green restoring device, meaning a tool by means of which damages, in particular impressions in a golf green, caused by impacts of a golf ball can be repaired. Any unevenness in a grass surface may change the moving direction of the golf ball, and it is therefore important that such impact impressions are eliminated.

In golf playing there is used a green restoring device for repairing the impact impression that the ball makes in the green. The green restoring device also includes golf ball marker, or a marking button for marking the position of the golf ball on the play ground when said ball is to be lifted up. The marker button in placed adjacent the boll before the ball is allowed to be lifted. The marker button marks the exact position of the ball on the ground and indicates where the ball is to be replaced.

The green restoring device consists of a tool which is enclosed in a carrier and which, when used, is expelled a certain distance out of said carrier. A green repairing tool of the said type is known for instance from the U.S. Pat. No. 6,413,174. In said patent the carrier comprises two plates having opposed cavities which provide a hollow space into and out of which the tool can be introduced and expelled resp. The displacements are made into several fixed positions which are marked by means of a spring pin which engages corresponding recesses in the lower one of the two co-operating plates. For protecting the upper side and the lower side said known green repair tool is formed with upper and lower sides. The lower side is additionally formed with a carrier for a marker.

The known apparatus involves a couple of disadvantages. When retracting the tool into the carrier, after the tool has been used, some sand, gravel and other dirt or impurities irrevocably follow the tool into the carrier, and this may make it difficult or impossible to once again expel the tool. At the same time some impurities also fall down into the pocket in which the green repair tool is kept during the golf tour. Further, the indications for the positions of the tool in the carrier, comprising the spring button and the relatively shallow recesses therefore in the bottom plate of the carrier provide a markedly weak locking of the tool, and due thereto the tool may unintentionally be introduced into the carrier when subjected to the relatively strong pressure which is necessary for having the tool become pressed down into the ground. Further, said known green repair tool consists of many different parts, and it is complicated and expensive to manufacture.

Further, the known green repair tool has blund outer edges, and it is therefore difficult to have said tool penetrate hard green soil. Depending on the blunt outer edges of said tool it also can not be used for cleaning the scores or grooves in the club head.

An important function of the apparatus is that the tool is safely locked in its expelled position in the carrier during the green restoring operation. The tool, which is formed as a metal plate having a recess extending in the longitudinal direction and which is converging in the direction inwards, can be pressed down into the ground for bringing up a grass divot which is thereafter placed in the impression in the green caused by the impact of the golf ball. The pressure of the tool often can be very strong when said tool is pressed down in the ground, and it is thereby important that the tool is not unintentionally pressed back, more or less, into the carrier. The green restoring device according to the present invention therefore is formed with a safe, but easily releasable, locking of the tool in its expelled position.

It is also important that it is prevented that sand, gravel and other dirt is introduced into the carrier when the tool is retracted after an impact impression has been restored. Therefore the carrier is, according to the invention, at the front edge thereof formed with a cleaning means which sweeps or brushes off existing dirt and the bottom side of the tool, and eventually also the upper side thereof. This also prevents dirt from falling down into the pocked in which the green restoring device is normally kept.

The green restoring device according to the invention is of a simple construction and comprises a carrier made as an integral piece, for instance made by extrusion of aluminium, plastic or any other suitable material, which carrier has a through elongated slot for the tool, a recess at the underside thereof, adjacent the front end, in which a marker button can be kept locked by means of a magnet or in another way, a smaller cavity and the rear side of the carrier for housing of a magnet intended to keep the tool maintained in its fully retracted position, a further cavity at the rear side of the carrier for fixedly mounting of a holder clip, by means of which the green restoring device can be hanged at the edge of a trouser pocket, at the edge of another pocket or at any other place.

An important feature of the green restoring device according to the invention is that it is formed with a cleaning means at, or adjacent the front edge thereof, which cleans the bottom side of the tool and/or the upper side thereof while retracting said tool after it has been used for restoring the green, and which also prevents sand, gravel or any other dirt from becoming retracted into the carrier when the tool is retracted into the carrier, and which also minimizes the intake of gravel into the pocked in which the green restoring device is kept.

Thanks to the existence of the cleaning means and the protecting properties of the carrier it is possible make the ends of the tool more pointed and narrower than has been usual, and this makes it easier to press down the tool into the ground at the place where the impact impression is to be restored. Thereby the tool also leaves less openings in the ground after it has been used. The pointed ends of the tool also are useful for clearing the grooves of the golf club head. The green restoring device is normally kept un-protected in the pocket of the trousers, and it is thereby important that the pointed and sharp tool does not damage the fabric of the pocket of the hand which is to handle the green restoring device.

The invention now is to be described more closely with reference to the accompanying drawings. In the drawings FIG. 1 shows a green restoring device as seen in a perspective view obliquely from above and with the tool in its retracted position.

Figure 1:
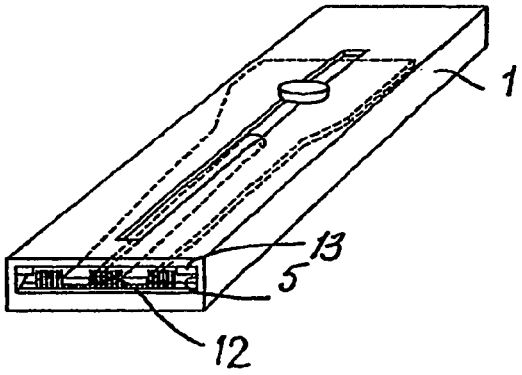
Figure 2:
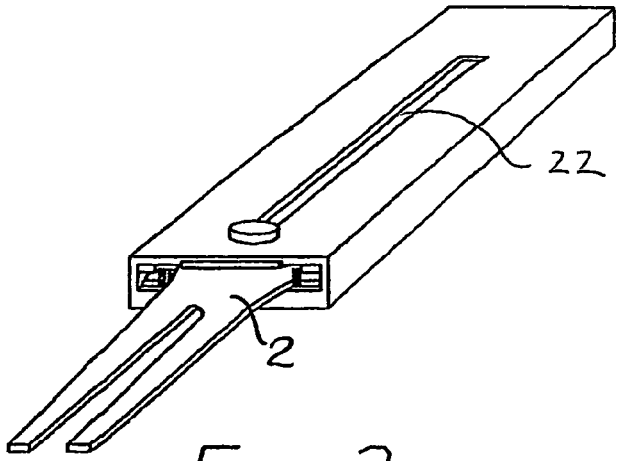
FIG. 2 shows the green restoring device in the same way as in FIG. 1 but with the tool in its expelled position.
Figure 3:
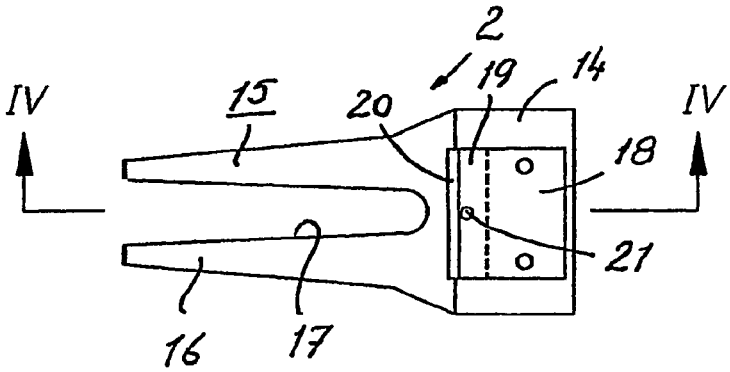
FIG. 3 is a top plan view of the tool of the green restoring device.
Figure 4:
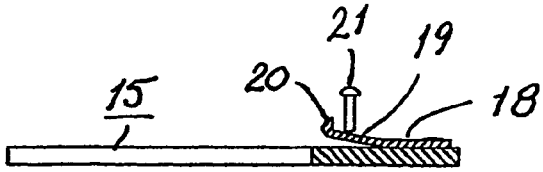
FIG. 4 is a cross section view through the tool, as seen along line IV-IV of FIG. 3.

The green restoring device shown in FIGS. 1-11 generally comprises a carrier 1, a tool 2, a marker button 3 and may optionally be formed with a fixing clip 4.

The carrier 1 can be made by extrusion in an integral piece of material of a type on non-magnetic material, like aluminium or a plastic material. The carrier is formed an inner longitudinal slot 5 for the tool 2, a preferably circular recess 6 adjacent the front edge of the carrier, which recess is, at the bottom thereof, formed with a rectangular magnet 7 for easily releasable holding a marker button 3 fixed thereto. At the rear end the carrier is formed with a slot 8 for mounting of a magnet 9 intended to keep the tool 2 secured when introduced in the carrier 1. At the rear edge there may also be a slot 10 for optionally introducing and locking of a fixing clip 4, by means of which the green restoring device can be hanged in the edge of a pocket, in a belt-of-similar. At the front edge the carrier is also formed with a recess 11, in which a brush 12 for cleaning the tool 2 can be mounted. Adjacent to each side edge at the upper side the carrier is formed with a rib 13 for guiding the tool 2. The brushes are preferably mounted in a plastic carrier which is secured in the recess(es) 11 by means of spikes or similar projecting means which engage the sides of said recess(es).

The tool is made as a plate of magnetic material, which comprises a guiding base part 14 having parallel side edges which are guided between the ribs 13, and a fork like end part 15, the arrow shaped branches 16 of which extend at an angle out from each other thereby forming a converging slot 17. The branches 16, which are preferably formed with serrated edges, are suited for being pressed obliquely down into the ground and for digging up a sand/grass divot adapted to be placed in an impact impression caused by the impact of a golf ball. The base 14 of the tool has a spring clamp 18 at the upper side thereof, which clamp is riveted or welded to said base, and which with a front end thereof provides an bent up spring 19 having a hook 20 intended to snap up and lock the tool 2 against the front edge in its expelled position. Alternatively the clip 18 is formed so that it can slide in the transversal direction so that the releasing button 21 can not become locked in the guide slot 22 or can be braked in said slot 22. The outer end hook 20 of the spring clamp preferably is formed as C to the effect that said hook can be locked against the locking rib 23, thereby keeping the tool in expelled position also when the tool 2 is used in solid and hard soil.

For releasing of the spring 19, 20 that hat snapped up it is formed with a releasing button 21 which upon depression releases the hook 20 so that the tool can be introduced in the carrier. At the upper side the carrier is, to that end, formed with a longitudinal slot 22 in which the releasing button 21 can slide between a fully retracted and a fully expelled position.

Figure 11:
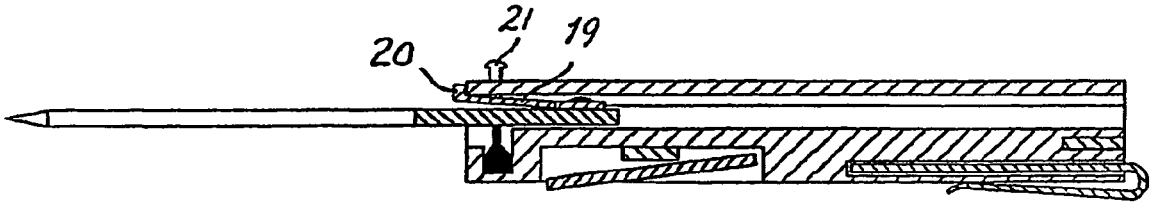

The marker button 3 is preferably of a magnetic material and has a slightly less area than that of the recess 6. The magnet 7 for the button has less diameter than that of the recess, it projects slightly above the bottom of the recess, so that the button 3 can be released by pressing same at a place of the edge thereof, as indicated in FIG. 11.

The tool is kept in place by magnetic action in its fully retracted position in that the magnet 9 at the rear end of the carrier 1 actuates the guiding base 14 or the spring clamp 18, which is made of some magnetic material.

Figure 5:
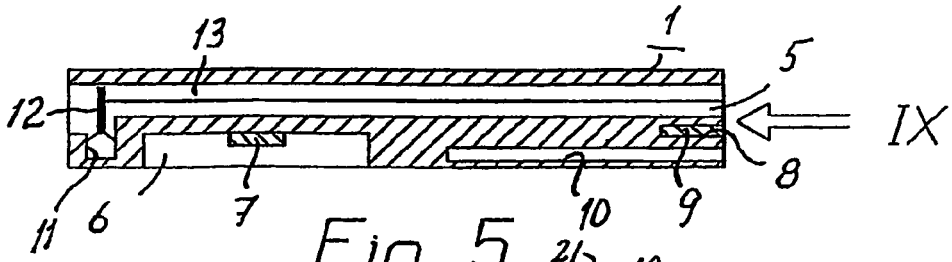
FIG. 5 is a vertical cross section through the carrier.
Figure 6:
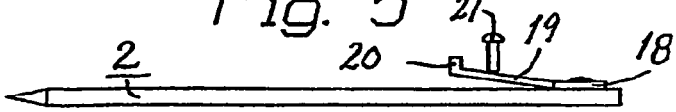
FIG. 6 is a side view of the tool.
Figure 7:
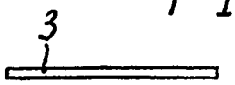
FIG. 7 shows a side view of a marker button.
Figure 8:
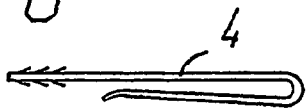
FIG. 8 shows a side view of a holder clip.
Figure 9:
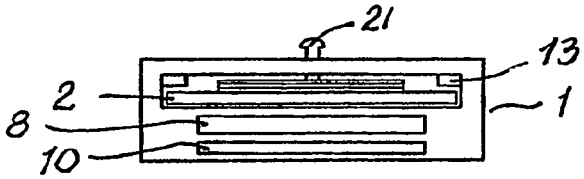
FIG. 9 is a view from behind of the green restoring device as seen in the direction of the arrow XI of FIG. 5. The opening of FIG. 9 is covered by a protection material having a possibility of opening the cavity for the holder clip.
Figure 10:
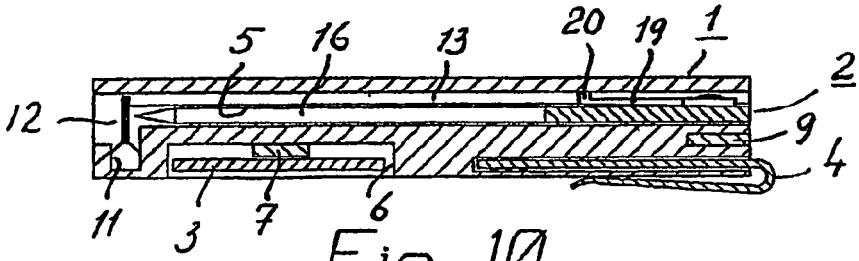
FIG. 10 is a vertical cross section view through a complete green restoring device shown with the tool retracted into the carrier, and FIG. 11 correspondingly shows the green restoring device with the tool in its expelled position.
Figure 12:
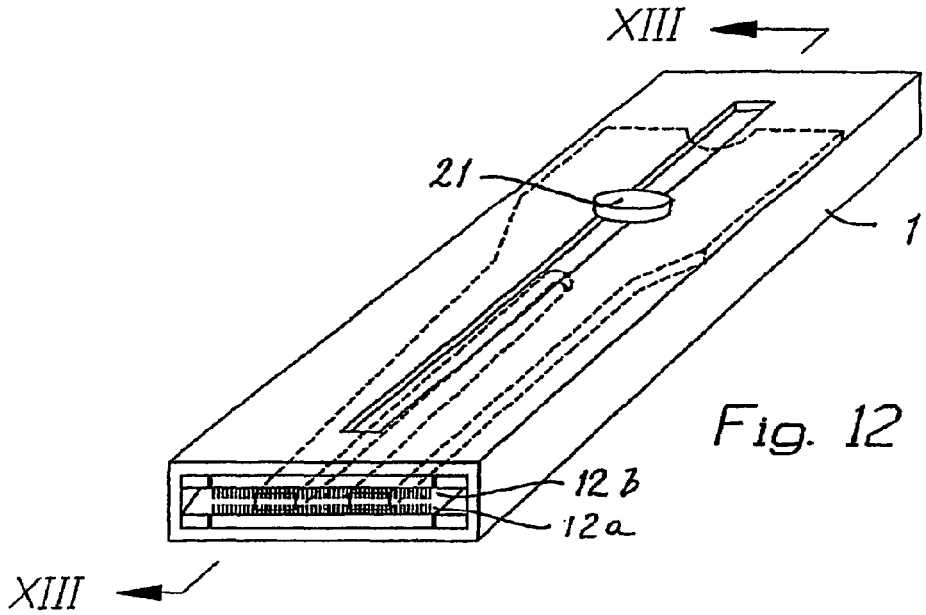
FIG. 12 shows an alternative embodiment of a green restoring device according to the invention seen in a perspective view obliquely from above.
Figure 13:
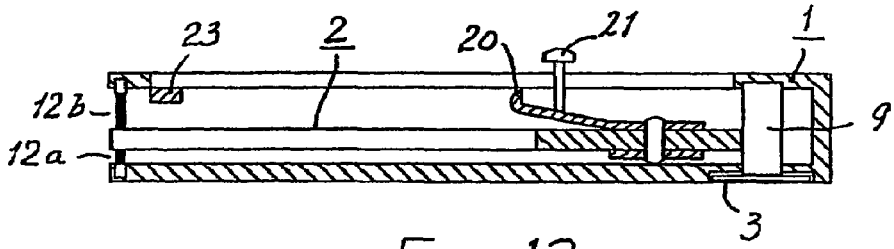
FIG. 13 shows a longitudinal cross section through the green restoring device according to FIG. 12, as seen along line XII-XII, with the tool in its retracted position.
Figure 14:
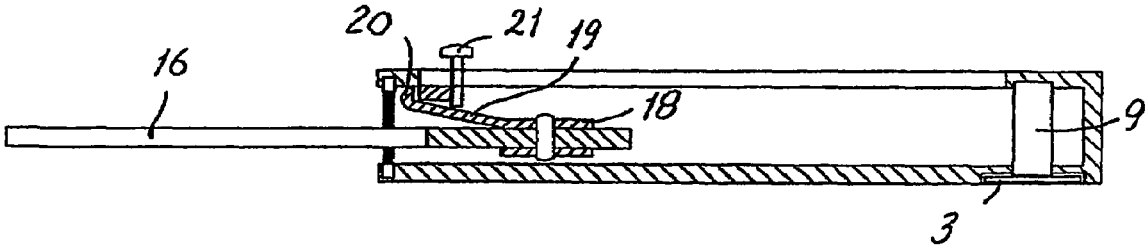
FIG. 14 shows the same cross section view as in FIG. 13 but with the tool in its expelled position.

As most clearly shown in FIG. 5 the carrier is, at the front end thereof, formed with a recess 11 in which a cleaning means 12, for instance a brush, a pad or another means is mounted for scratching off sand, gravel or any other dirt from the tool 2 when said tool is retracted into the carrier. As indicated in FIGS. 12-14 the device can be formed with two separate cleaning means, one means 12*a* acting against the bottom side of the tool, the second means 12*b* acting against the top side of the tool. In this latter case it may be suitable to provide a locking rib 23 slightly inside of the end of the carrier, against which rib 23 the spring hook engages lockingly in the expelled position, see FIG. 14.

For making it possible to hook connect the green restoring device to some article of clothing it is formed with an fixing clip 4 which can be introduced into the slot 10.

When using the device the tool 2 is expelled out of the carrier by actuating the button 21 until the hook 20 engages the front edge of the carrier or the locking rib 23, so that the tool is maintained safely in its expelled position. The tool is thereafter pressed down into the ground aside of an impression caused by an impact of a golf ball, and a suitably large divot of grass or soil is bent up and is placed in the impact impression and is pressed down so that the ground becomes even again. After the restoring of the impact impression the releasing button 21 is pressed down, so that the spring hook 20 gets free from the front edge of the carrier, or from the locking rib 23, whereupon the tool is retracted into the carrier, where it is kept in place by co-operation with the magnet 9 and the magnetic material of the tool and/or the spring clamp 18 thereof.

REFERENCE NUMERALS

1 carrier
2 tool
3 marker button
4 fixing clip
5 slot for tool
6 recess (for marker button)
7 magnet
8 slot
9 magnet
10 slot for clip
11 recess for brush
12 brush (a, b)
13 rib
14 guiding base
15 fork like end
16 branches
17 slot
18 spring clamp
19 spring
20 spring hook
21 releasing button
22 slot (longitudinal)
23 locking rib

The invention claimed is:

1. A green restoring device for repairing damages in a golf green, said green restoring device comprising:

a carrier in which a green restoring tool is arranged to be maintained in fully retracted and fully expelled position, respectively, characterized in that the carrier of the green restoring device, at the front end thereof, is formed with means for cleaning the tool while the tool is retracted into the carrier;

wherein the means for cleaning the tool comprises a cross extending brush which is mounted with a base thereof in a recess in a lower and upper part of the carrier and with the brush in contact with the lower side and the upper side of the tool for striking off debris when the green restoring tool is moved.

2. The green restoring device according to claim 1, characterized in that the carrier is formed as an integral piece of material.

3. The green restoring device according to claim 2, characterized in that the carrier is formed with an elongated slot, in which the tool can be displaced between a full retracted and a fully expelled position.

4. The green restoring device according to claim 3, characterized in that the tool is formed as a plate having a guiding base and two fork branches projecting forwardly and arranged converging to each other, thereby leaving a conically outwards extending slot, and which on at least one side thereof, carries a spring clamp having a spring with an outer locking hook which is arranged to spring-lockingly engage a part of the carrier, so as to be kept locked in the carrier in fully expelled position.

5. The green restoring device according to claim 4, characterized in that the spring with the locking hook is arranged for being released by means of a releasing button engaging the spring and projecting through a slot of the carrier, and which by being depressed presses down and releases the locking hook from its engagement with the part of the carrier.

6. The green restoring device according to claim 5, characterized in that a part of the tool is of a magnetic material, and in that the rear part of the carrier, is formed with a magnet which holds the tool by magnetic action in the fully retracted position of the tool in the carrier.

7. The green restoring device according to claim 6, characterized in that the carrier and the lower side thereof and at the front part thereof is formed with a recess for receiving and retaining a marker button.

8. The green restoring device according to claim 1, characterized in that the carrier, at the rear part thereof, has a slot in which a fixing clip is adapted to be mounted, which clip is formed for allowing a holding of the green restoring device.

9. The green restoring device according to claim 4, wherein the part of the carrier engagable with the hook is selected from the group consisting of an outer edge of the carrier, and a locking rib.

10. The green restoring device according to claim 7, wherein the recess is circular and has, at the bottom thereof, a projecting magnet which has less diameter than the diameter of the recess, and wherein the marker button is made of a magnetic material.

11. The green restoring device according to claim 1 further comprising a rib adjacent to each side edge at the upper side of the carrier for guiding the green restoring tool.

12. A green restoring device comprising:

a carrier having a front end, a rear end, an upper side, a lower side, a defined inner longitudinal slot, a recess formed in the lower side, and a defined slot running longitudinally on the upper side;

a green restoring tool adapted to be retracted and expelled within the longitudinal slot of the carrier and through the front end of the carrier, the green restoring tool being formed as a plate having a guiding base and two fork branches projecting forwardly and arranged converging to each other, thereby leaving a conically outwards extending slot, and which on at least one side thereof carries a spring clamp having a spring with an outer locking hook which is arranged to releasably engage a part of the carrier, so as to be kept locked in the carrier in fully expelled position; and a cross extending brush having a base mountable in a recess adjacent the front end of the carrier, the brush being in contact with the green restoring tool for striking off debris when the green restoring tool is retracted and expelled from the carrier.

13. The green restoring device according to claim 12, wherein the spring with the locking hook is arranged for being released by means of a releasing button engaging the spring and projecting through the upper defined slot of the carrier, and which by being depressed presses down and releases the locking hook from its engagement with the part of the carrier.

14. The green restoring device according to claim 12, wherein a rearward part of the green restoring tool is made of a magnetic material, and in that the rear part of the carrier is formed with a magnet which holds the green restoring tool by magnetic action in the fully retracted position of the green restoring tool in the carrier.

15. The green restoring device according to claim 12, wherein the part of the carrier engagable with the hook is selected from the group consisting of an outer edge of the carrier, and a locking rib.

16. The green restoring device according to claim 12, wherein the recess in the lower side of the carrier has a circular configuration and has, at the bottom thereof, a projecting magnet which has less diameter than the diameter of the recess, and wherein a marker button made of a magnetic material is received and releasable retained therein.

17. The green restoring device according to claim 12 further comprising a rib adjacent to each side edge at the upper side of the carrier for guiding the green restoring tool.

18. The green restoring device according to claim 12, wherein the cross extending brush is a pair of cross extending brushes each having a base, with the base of one brush being mountable in a recess in the lower side adjacent the front end of the carrier, and the base of the opposite brush being mountable in a recess in the upper side adjacent the front end of the carrier, thereby allowing the brushes to contact the lower and upper sides of the green restoring tool.

19. A green restoring device comprising:

a carrier having a front end, a rear end, an upper side, a lower side, a defined inner longitudinal slot, a recess formed in the lower side, and a defined slot running longitudinally on the upper side;

a green restoring tool adapted to be retracted and expelled within the longitudinal slot of the carrier and through the front end of the carrier, the green restoring tool being formed as a plate having a guiding base and two fork branches projecting forwardly and arranged converging to each other, thereby leaving a conically outwards extending slot, and which on at least one side thereof carries a spring clamp having a spring with an outer locking hook which is arranged to releasably engage a part of the carrier, so as to be kept locked in the carrier in fully expelled position; and a cross extending brush having a base mountable in a recess adjacent the front end of the carrier, the brush being in contact with the green restoring tool for striking off debris when the green restoring tool is retracted and expelled from the carrier;

wherein the carrier further comprising a rib adjacent to each side edge at the upper side of the carrier for guiding the green restoring tool;

wherein a rearward part of the green restoring tool is made of a magnetic material, and in that the rearward part of the carrier is formed with a magnet which holds the green restoring tool by magnetic action in the fully retracted position of the green restoring tool in the carrier;

wherein the rearward part of the carrier defines a slot adapted to releasably receive a fixing clip for allowing a holding of the green restoring device.

* * * * *